US008925914B2

(12) United States Patent
Naoi

(10) Patent No.: US 8,925,914 B2
(45) Date of Patent: Jan. 6, 2015

(54) TRAY AND AN IMAGE FORMING APPARATUS PROVIDED WITH THE TRAY

(71) Applicant: Konica Minolta, Inc., Tokyo (JP)

(72) Inventor: Shinya Naoi, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/087,015

(22) Filed: Nov. 22, 2013

(65) Prior Publication Data

US 2014/0145393 A1 May 29, 2014

(30) Foreign Application Priority Data

Nov. 28, 2012 (JP) ..... 2012-259852

(51) Int. Cl.
*B65H 1/22* (2006.01)
*B65H 1/04* (2006.01)

(52) U.S. Cl.
CPC ..... *B65H 1/04* (2013.01)
USPC ..... 271/164; 271/145

(58) Field of Classification Search
USPC ..... 271/145, 162, 164; 399/393; 312/333, 312/332.1, 222
See application file for complete search history.

(56) References Cited

FOREIGN PATENT DOCUMENTS

JP 2006-008291 A 1/2006
JP 2010-030692 A 2/2010

OTHER PUBLICATIONS

Machine translation of JP 2006-8291, retrieved May 4, 2014.*

* cited by examiner

*Primary Examiner* — Michael McCullough
(74) *Attorney, Agent, or Firm* — Lucas & Mercanti, LLP

(57) ABSTRACT

A tray drawable from an image forming apparatus body in a specified first direction, the tray having: a tray body in which printing media are stored; a handle that is fastened to the tray body so as to be slidable in the first direction by a specified distance, a pull of the handle in the first direction effecting a slide of the handle in the first direction relative to the tray body and applying a pull force in the first direction to the tray body; a lock mechanism for locking the tray body in the image forming apparatus body, the slide of the handle in the first direction relative to the tray body cancelling the lock mechanism; and an elastic member located between the handle and the tray body; wherein at least part of the pull force is transmitted from the handle to the tray body via the elastic member.

16 Claims, 6 Drawing Sheets

TRAY AND AN IMAGE FORMING APPARATUS PROVIDED WITH THE TRAY

This application is based on Japanese Patent Application No. 2012-259852 filed on Nov. 28, 2013, the content of which is herein incorporated by reference.

BACKGROUND OF THE INVENTION

1. Field of the Invention

The present invention relates to a tray and an image forming apparatus provided with the tray, and more particularly to a tray that is constructed to be drawable in a specified first direction from the body of an image forming apparatus, and an image forming apparatus provided with the tray.

2. Description of Related Art

As a conventional tray, there is known, for example, a lockable storage cassette (which will be referred to as storage cassette) disclosed by Japanese Patent Laid-Open Publication No. 2006-8291. FIG. 10 is an exploded perspective view of a handle 500 of the storage cassette disclosed by Japanese Patent Laid-Open Publication No. 2006-8291.

The handle 500 is a part of the storage cassette, and comprises a grip 520, a support 521, bolts 522 and a lock mechanism 523. The support 521 serves as the body of the handle 500, and the support 521 is joined to a cassette body on which printing media are stacked. The bolts 522 are attached to the support 521. In order to draw the storage cassette from the body of the image forming apparatus, a user pulls the grip 520. A long hole 520*a* is made in the grip 520. One of the bolts 522 is inserted in the long hole 520*a*, whereby the grip 520 is joined to the support 521 so as to be slidable to and from the support 521. The lock mechanism 523 is a mechanism for locking the handle 500 in the body of the image forming apparatus. The lock mechanism 523 is constructed such that the handle 500 is unlocked from the body of the image forming apparatus with a pull and slide of the grip 520 from the support 521.

The storage cassette of the above-described structure as disclosed by Japanese Patent Laid-Open. Publication No. 2006-8291 has a problem that it makes a collision noise when drawn from the body of the image forming apparatus. More specifically, when the storage cassette is drawn from the body of the image forming apparatus, the grip 520 is pulled to slide, whereby the grip 500 is unlocked from the body of the image forming apparatus. Thereafter, the bolt 522 is caught in the grip 520, and the force applied to the grip 520 is transmitted to the support 521 via the bolt 522. During the series of actions, when the bolt 522 is caught in the grip 520, a collision noise is made.

SUMMARY OF THE INVENTION

An object of the present invention is to provide a tray that can reduce collision noise occurring with a draw of the tray, and an image forming apparatus provided with the tray.

A tray according to an embodiment of the present invention is constructed to be drawable from an image forming apparatus body in a specified first direction, and the tray comprises: a tray body in which a plurality of printing media are stored; a handle that is fastened to the tray body so as to be slidable in the specified first direction by a specified distance, a pull of the handle in the specified first direction effecting a slide of the handle in the first direction relative to the tray body and applying a pull force in the specified first direction to the tray body; a lock mechanism for locking the tray body in the image forming apparatus body, the slide of the handle in the specified first direction relative to the tray body cancelling the lock mechanism to unlock the tray body from the image forming apparatus; and, an elastic member located between the handle and the tray body. In the tray, at least part of the pull force is transmitted from the handle to the tray body via the elastic member.

An image forming apparatus according to an embodiment of the present invention comprises and image forming apparatus body and the above-described tray.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

A tray and an image forming apparatus according to an embodiment of the present invention will be described with reference to the accompanying drawings.

Structure of the Image Forming Apparatus

Figure 1:
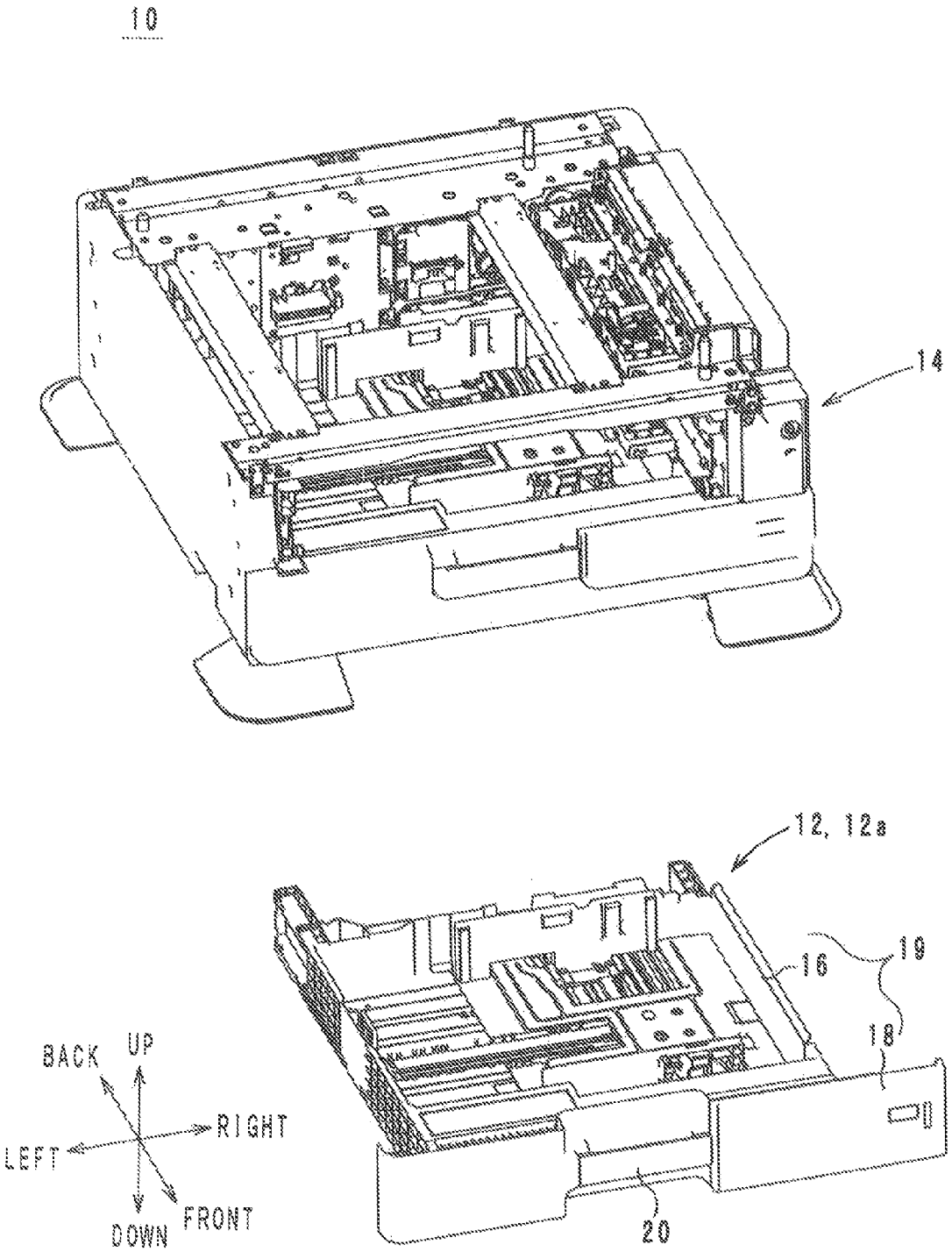
FIG. 1 is a perspective view of a sheet feeder of an image forming apparatus.
Figure 2:
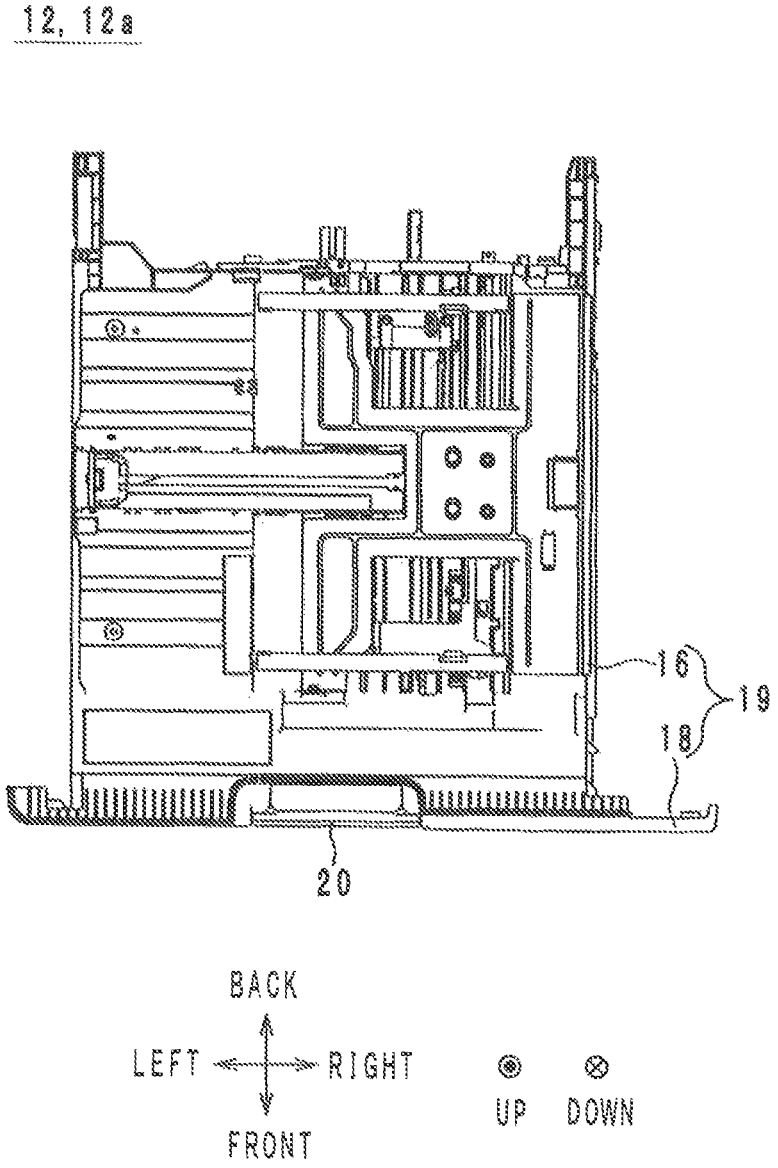
FIG. 2 is a top view of a tray.
Figure 3:
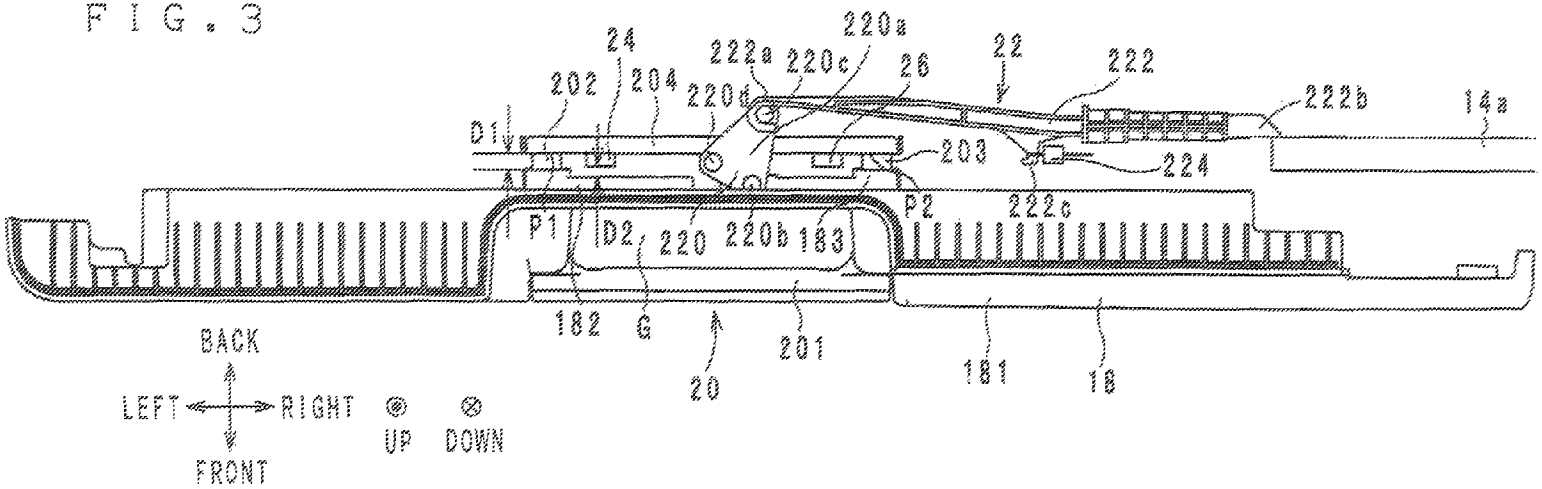
FIG. 3 is a view showing the structure of a front cover of the tray.

An image forming apparatus according to an embodiment of the present invention is described with reference to the accompanying drawings. FIG. 1 is a perspective view of a sheet feeder of the image forming apparatus 10. FIG. 2 is a top view of a tray 12. FIG. 3 is a view showing the structure of a front cover 18 of the tray 12. FIG. 3 shows a state wherein the tray 12 is fitted in the body of the sheet feeder. In the following paragraphs, the front-back direction of the image forming apparatus 10 is simply referred to as a front-back direction. The right-left direction of the image forming apparatus 10 when viewed from the front side of the image forming apparatus 10 is simply referred to as a right-left direction. The up-down direction of the image forming apparatus 10 is simply referred to as an up-down direction.

The image forming apparatus 10 is an electrophotographic color printer that forms a full-color image by combining four color (Y: yellow, M: magenta, C: cyan and K: black) images by a tandem method. The image forming apparatus 10 has a function to form an image on a sheet in accordance with image data read by a scanner. The mechanism of the image forming apparatus 10 to form an image on a sheet is well known, and the mechanism is not described here.

The image forming apparatus 10 comprises a tray 12 and a sheet feeder body 14 as shown by FIG. 1. Although a printing section is provided above the sheet feeder body 14, the printing section is not shown in FIG. 1.

The sheet feeder body 14 is located at the bottom of the body of the image forming apparatus 10. As shown in FIG. 1, an opening that extends in the right-left direction is made at the front side of the body of the image forming apparatus 10. As shown in FIG. 1, the tray 12 is fitted in the opening, and the tray 12 is constructed to be drawable to the front from the sheet feeder body 14. As shown in FIGS. 1 to 3, the tray 12 comprises a tray body 19, a handle 20, a lock mechanism 22 and elastic members 24 and 26.

In the tray body 19, a plurality of sheets (printing media) stacked in the up-down direction are stored. The tray body 19 comprises a sheet storage section 16 and a front cover 18. The sheet storage section 16 is an open-topped box in the shape of a rectangular parallelepiped, in which sheets are stored. The sheet storage section. 16 comprises a mechanism for lifting the sheets so as to allow the sheet feeder body 14 to pick up a sheet easily, and other mechanisms. Since these mechanisms are well known, the mechanisms are not described here.

The front cover 18 is fixed to a front side of the storage section 16, and comprises a cover body 181 and contact parts 182 and 183. The cover body 181 is a long rectangle extending in the right-left direction. A center portion of the cover body 181 with respect to the right-left direction is concaved from the front to the back, whereby a recess G is formed. The contact parts 182 and 183 are resin members fastened to the back side of the cover body 181, and are located to overlap with the recess G when viewed from the front-back direction. The contact part 182 is located at the left, and the contact part 183 is located at the right. As will be described later, when the handle 20 is pulled to the front, the contact part 182 comes into contact with the handle 20 and the elastic member 24, and the contact part 183 comes into contact with the handle 20 and the elastic member 26.

As shown in FIG. 3, the handle 20 is fastened to the tray body 19 (more specifically to the front cover 18) so as to be slidable to the front by a specified distance D1. The handle 20 comprises a grip 201, shafts 202, 203 and a contact part 204. The grip 201, which is to be gripped by a user, is a strip-like resin member extending in the right-left direction. The grip 201 is located in the recess G.

The shaft 202 is a stick-like member extending backward from the left end of the grip 201. The shaft 202 is inserted in a hole (not shown) pierced in the cover body 181 and the contact part 182 in the front-back direction. Thereby, the back end of the shaft 202 sticks out from the contact part 182. The shaft 203 is a stick-like member extending backward from the right end of the grip 201. The shaft 203 is inserted in a hole (not shown) pierced in the cover body 181 and the contact part 183 in the front-back direction. Thereby, the back end of the shaft 203 sticks out from the contact part 183.

The contact part 204 is a strip-like metal member extending in the right-left direction and is in contact with the back ends of the shafts 202 and 203. The contact part 204 is to apply force to the tray body 19, and therefore, the contact part 204 is made of a strong metal material. As shown by FIG. 3, the handle 20, which is composed of the grip 201, the shafts 202, 203 and the contact part 204 as described above, is in the shape of a square when viewed from above. Also, as shown in FIG. 3, the contact parts 182 and 183 are located at a specified distance D1 from the contact part 204. Thereby, the handle 20 is slidable to the front by the specified distance D1 relative to the front cover 18.

The elastic members 24 and 26 are located between the handle 20 and the tray body 19, and are rectangular members made of rubber, elastic resin or the like. More specifically, as shown in FIG. 3, the elastic members 24 and 26 are fixed to the front side of the contact part 204. The elastic member 24 is located near the shaft 202, and the elastic member 26 is located near the shaft 203. As shown in FIG. 3, while the tray 12 is fitted in the sheet feeder body 14, the elastic members 24 and 26 are not in contact with the contact parts 182 and 183. The respective distances D2 between the elastic member 24 and the contact member 182 and between the elastic member 26 and the contact member 183 are smaller than the distance D1.

The lock mechanism. 22 is to lock the tray body 19 in the sheet feeder body 19. As shown in FIG. 3, the lock mechanism 22 comprises a connector 220, a stopper 222 and a spring 224. The connector 220 comprises a connector body 220*a*, and shafts 220*b* to 220*d*. The connector body 220*a* is a plate-like member in the shape of a triangle when viewed from above. The shafts 220*b* to 220*d* are located respectively at the three corners of the triangular connector body 220*a*, and extend downward from the connector body 220*a*. The shaft 220*b* is stuck in the contact part 183. The shaft 220*c* engages with the stopper 222 as will be described later. The shaft 220*d* is in contact with the front side of the contact part 204. The connector 220 of the structure as thus described is capable of pivoting on the shaft 220*b*.

As shown in FIG. 3, the stopper 222 engages with the connector 220, and while the tray 12 is fitted in the sheet feeder body 14, the stopper 222 engages with a catching part 14*a* of the sheet feeder body 14. More specifically, the stopper 222 comprises a hook 222*a*, a catching part 222*b* and another hook 222*c*. The hook 222*a* is at the left end of the stopper 222. The hook 222*a* is U-shaped and engages with the shaft 220*c*. The catching part 222*b* is at the right end of the stopper 222. While the tray 12 is fitted in the sheet feeder body 14, the front side of the catching part 222*b* is in contact with the catching part 14*a*. Thereby, the tray 12 is prevented from moving frontward relative to the sheet feeder body 14. The hook 222*c* sticks out frontward from the center of the stopper 222 with respect to the right-left direction, and the hook 222*c* is U-shaped.

The spring 224 is a tension spring that pulls the stopper 222 to the right. More specifically, the left end of the spring 224 is hooked by the hook 222*c* of the stopper 222, and the right end of the spring 224 is hooked by the sheet feeder body 14. Thereby, the stopper 222 is pulled to the right, and the engagement between the catching part 222*b* and the catching part 14*a* as shown in FIG. 3 can be kept.

Figure 4:
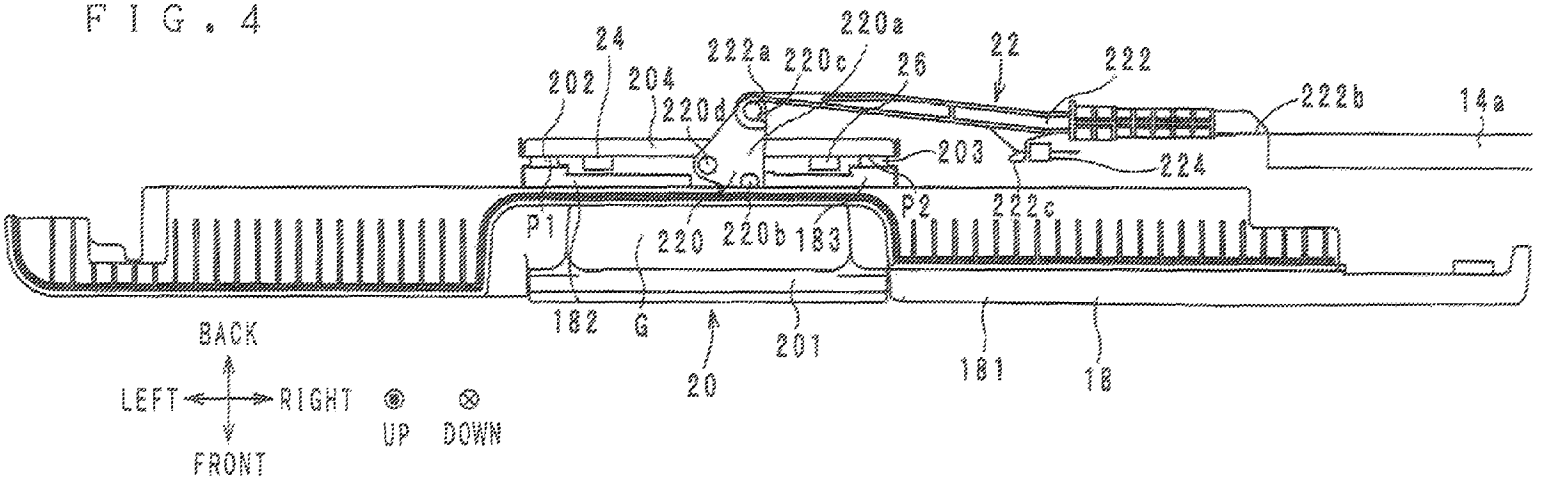
FIG. 4 is a view of the front cover of the tray and its vicinity in a process of drawing the tray from a sheet feeder body.
Figure 5:
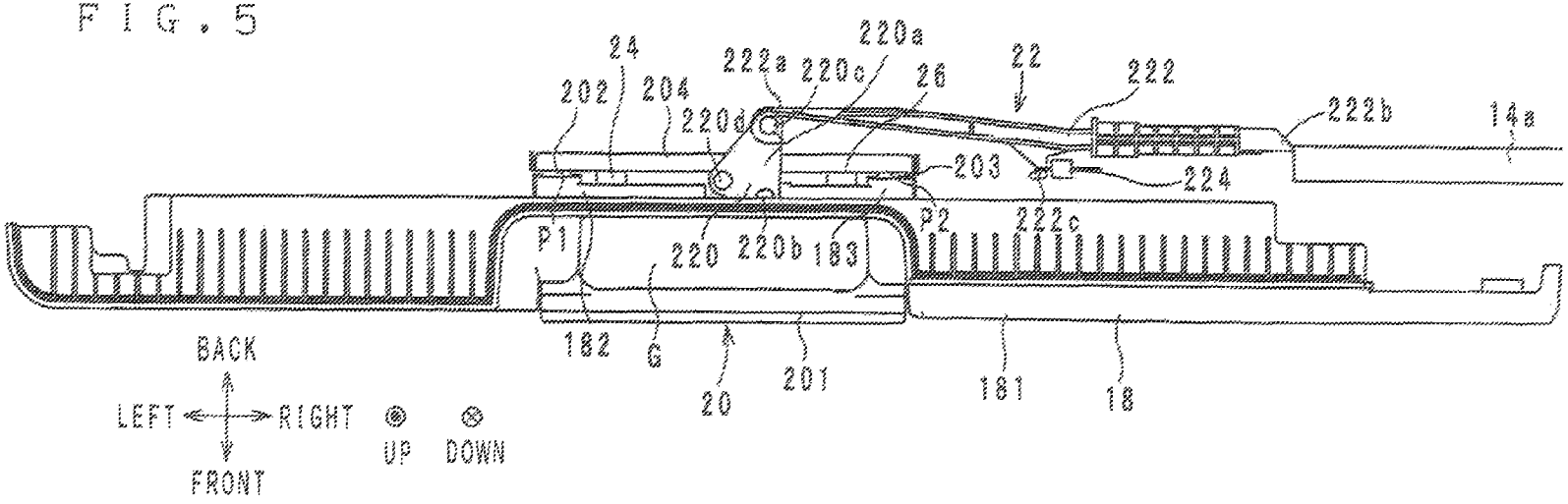
FIG. 5 is a view of the front cover of the tray and its vicinity in the process of drawing the tray from the sheet feeder body.
Figure 6:
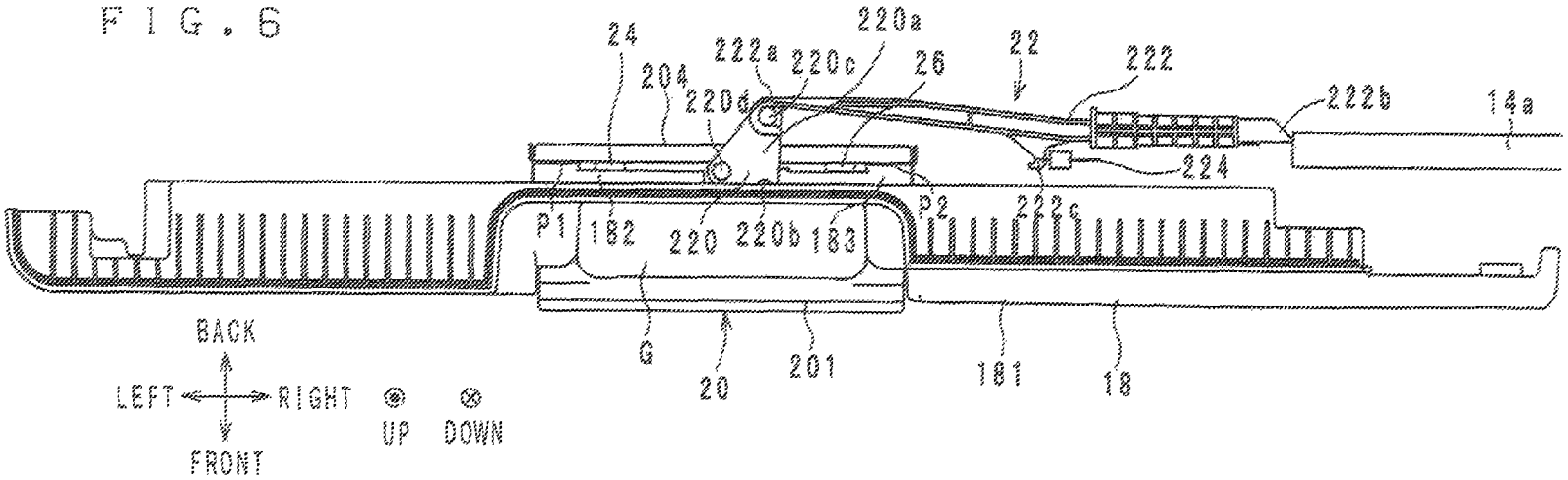
FIG. 6 is a view of the front cover of the tray and its vicinity in the process of drawing the tray from the sheet feeder body.

Next, a process of pulling out the tray 12 from the sheet feed body 14 is described with reference to the accompanying drawings. FIGS. 4 to 6 show the states of the front cover 18 and its vicinity during the process of pulling out the tray 12 from the sheet feed body 14.

While the tray 12 is fitted in the sheet feeder body 14, the catching part 222*b* engages with the catching part 14*a* as shown in FIG. 3. Thereby, the tray 12 is locked in the sheet feed body 14 by the lock mechanism 22.

When a user pulls the handle 20, as shown by FIG. 4, the handle 20 slides slightly to the front relative to the front cover 18. Thereby, the shaft 220*d* is pushed to the front by the contact part 204, and the connector 220 pivots slightly counterclockwise on the shaft 220*b*. With the counterclockwise pivot of the connector 220, the stopper 222 is pulled, by the shaft 220*c* and slides to the left. Consequently, the catching part 222*b* disengages from the catching part 14*a*. Thus, the tray body 19 is unlocked from the sheet feeder body 14. In the state shown by FIG. 4, the elastic members 24 and 26 are not in contact with the contact members 182 and 183, respectively, and the contact member 204 is not in contact with the contact members 182 and 183.

When the user further pulls the handle 20, as shown by FIG. 5, the handle 20 slides further to the front relative to the front cover 18. Thereby, the elastic members 24 and 26 come into contact with the contact parts 182 and 183, respectively. Then, the force of the user's pulling the handle 20 is transmitted from the contact part 204 of the handle 20 to the contact parts 182 and 183 of the tray body 19 via the elastic members 24 and 26. Thereby, the tray 12 starts being drawn from the sheet feeder body 14. In the state shown by FIG. 5, the contact part 204 is not in contact with the contact parts 182 and 183.

When the user pulls the handle 20 still further, as shown by FIG. 6, the handle 20 slides to the front still further relative to the front cover 18. In the state shown by FIG. 6, the handle 20 has slid to the front relative to the tray body 19 by the specified distance D1. Since the distances D2 between the elastic member 24 and the contact part 182 and between the elastic member 26 and the contact part 183 are smaller than the distance D1, the elastic members 24 and 26 are squashed, and the contact part 204 comes into contact with the contact parts 182 and 183. The portions where the contact part 204 contacts with the contact parts 182 and 183 of the tray body 19 are referred to as contact portions P1 and P2, respectively. The contact portions P1 and P2 are located respectively at the left end and at the right end of the contact part 204, and the elastic members 24 and 26 are disposed between the contact portions P1 and P2.

In the state wherein the contact part 204 is in, contact with the contact parts 182 and 183, the contact part 182 is in contact with the elastic member 24 and the contact part 204, and the contact part 183 is in contact with the elastic member 26 and the contact part 204. Therefore, the force of the user's pulling the handle 20 is partly transmitted from the contact part 204 to the contact parts 182 and 183 of the tray body 19 via the elastic members 24 and 26. Thereby, the tray 12 is drawn from the sheet feeder body 14,

ADVANTAGEOUS EFFECTS

The tray 12 and the image forming apparatus 10 of the above-described structure can reduce collision noise occurring with a draw of the tray 12. More specifically, the elastic members 24 and 26 are provided between the contact part 204 of the handle 20 and the contact part 182 of the tray body 19 and between the contact part 204 of the handle 20 and the contact part 183 of the tray body 19, respectively. When the handle 20 is pulled to the front by a user, the handle 20 is caused to slide to the front relative to the tray body 19. Thereby, the elastic member 24 comes into contact with both the contact part 204 and the contact part 182, and the elastic member 26 comes into contact with both the contact part 204 and the contact part 183. Accordingly, at least part of the pull force applied to the handle 20 by the user is transmitted from the handle 20 to the tray body 19 via the elastic members 24 and 26. The elastic members 24 and 26 ease collisions between the contact part 204 and the contact part 182 and between the contact part 204 and the contact part 183, and the collision noise can be reduced. Also, since the collisions between the contact part 204 and the contact part 182 and between the contact part 204 and the contact part 183 are eased, the shock caused by a draw of the tray 12 from the sheet feeder body 14 can be reduced. Consequently, it becomes less likely that the shock effects a degradation of an image formed by the image forming apparatus 10.

In the tray 12 and the image forming apparatus 10, the distances D2 between the elastic member 24 and the contact part 182 and, between the elastic member 26 and the contact part 183 are smaller than the specified distance D1 that is the slidable distance of the handle 20. Therefore, the elastic members 24 and 26 come into contact, respectively, with both the contact part 182 and the contact part 204 and with both the contact part 183 and the contact part. 204 before the contact part 204 comes into contact with the contact parts 182 and 188. Thereby, the collisions between the contact part 204 and the contact part 182 and between the contact part 204 and the contact part 183 are effectively eased, and the collision noise is effectively reduced.

In the tray 12 and the image forming apparatus 10, also, the pull force is transmitted from the handle 20 to the tray body 19 via the elastic members 24 and 26 after the lock mechanism 22 is cancelled. Accordingly, after cancellation of the lock mechanism 22, the tray body 19 is drawn. It does not occur that the catching part 222*b* is pulled to the front during the process of cancelling the lock mechanism 22, and a great frictional force between the catching part 222*b* and the catching part 14*a* can be prevented. Thus, in the tray 12 and the image forming apparatus 10, the lock mechanism 22 can be cancelled smoothly.

The contact part 204 has contact portions P1 and P2 to come into contact with the contact parts 182 and 183 respectively. Accordingly, it is possible to set the slidable distance of the handle 20 toward the tray body 19 to the distance D1.

First Modification

Figure 7:
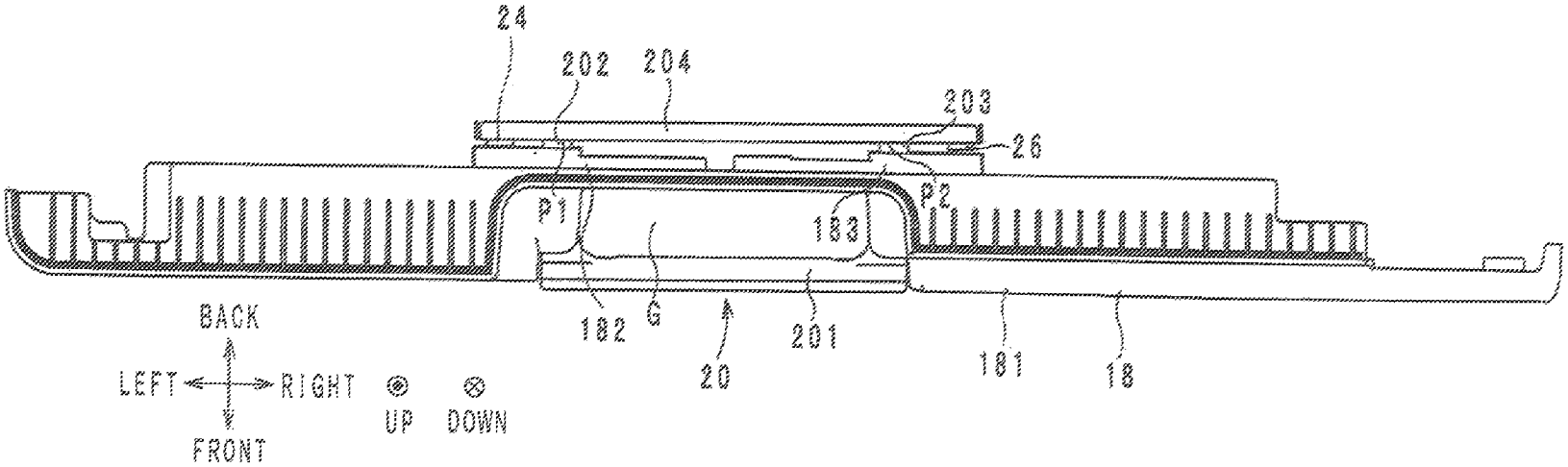
FIG. 7 is a view showing the structure of a front cover of a tray according to a first modification.
Figure 8:
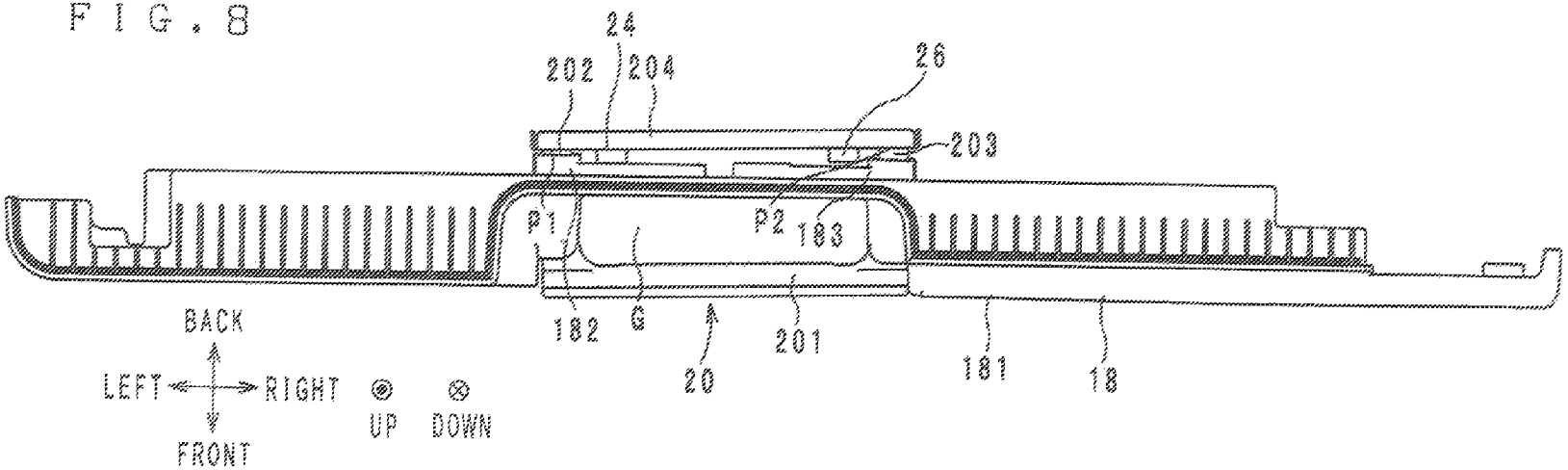
FIG. 8 is a view showing the front cover when the handle of the tray is pulled diagonally.

A tray 12*a* according to a first modification is described below with reference to the accompanying drawings. FIG. 7 shows the structure of the front cover 18 of the tray 12*a* according to the first modification. FIG. 8 shows the front cover 18 in a state where the handle 20 of the tray 12 is pulled diagonally. The general structure of the tray 12*a* is shown by FIGS. 1 and 2.

The tray 12*a* is different from the tray 12 in positions of the elastic members 24 and 26. More specifically, in the tray 12, the elastic members 24 and 26 are located between the contact portions P1 and P2. In the tray 12*a*, however, the contact portions F1 and P2 are located between the elastic members 24 and 26. As will be described below, this arrangement ensures a reduction of collision noise even if the handle 20 is pulled diagonally.

In the tray 12, when the handle 20 is pulled diagonally, the handle 20 tilts as shown in FIG. 8, and the contact part 204 tilts, so that the contact portion P1 of the contact part 204 may come into contact with the contact part 182 before the elastic members 24 and 26 come into contact with the contact parts 182 and 183, respectively. Thus, in the tray 12, when the handle 20 is pulled diagonally, collision noise may occur.

In the tray 12*a*, on the other hand, even when the handle 20 is pulled diagonally, the elastic members 24 or 26 come into contact with the contact part 182 or 183 before the contact portions P1 and P2 of the contact part 204 come into contact with the contact parts 182 and 183. Thus, in the tray 12*a*, even when the handle 20 is pulled diagonally, collision noise can be reduced.

Other Embodiments

Trays and image forming apparatuses according to the present invention are not limited to the trays 12, 12*a*, and the image forming apparatus 10 described above.

Figure 9:
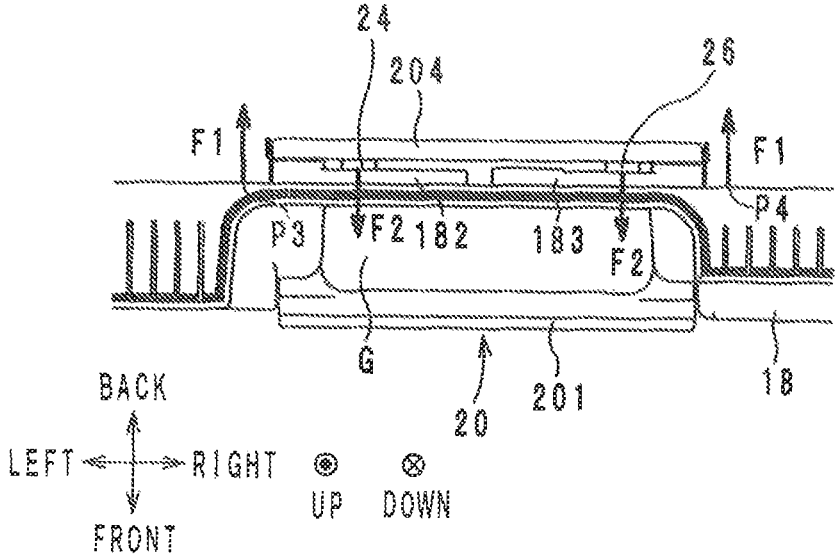
FIG. 9 is an illustration showing forces acting on the front cover of the tray.
Figure 10:
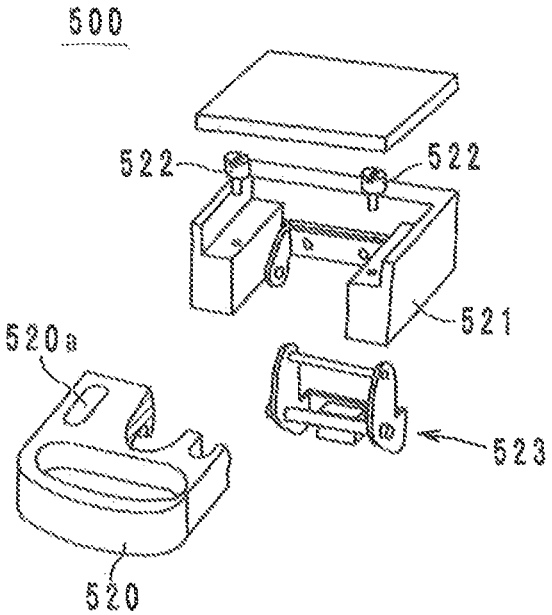
FIG. 10 PRIOR ART
FIG. 10 is an exploded perspective view of the handle of the storage cassette disclosed by Japanese Patent Laid-Open Publication No. 2006-8291.

As will be described below, in each of the trays 12 and 12*a*, it is preferred that the connections where the front cover 18 is fastened to the storage section 16 are in the same positions with respect to the lengthwise direction of the front cover 18 (the right-left direction) as the elastic members 24 and 26 are located. FIG. 9 shows the forces acting on the front cover 18 of the tray 12.

In the tray 12, the front cover 18 and the storage section 16 are connected together at points P3 and P4. Therefore, when the handle 20 is pulled, forces F2 are applied, from the handle 20 to the front cover 18 via the elastic members 24 and 26. The front cover 18 that is about to move to the front is pulled backward by the storage section. 16 with forces F1 at the points P3 and P4. If the points P3 and P4 are separate far from the elastic members 24 and 26, respectively, with respect to the right-left direction, the contact part 204 will be bent by the forces F1 and F2. In order to avoid the trouble, it is preferred that the points P3 and P4 are located near the elastic members 24 and 26, respectively, with respect to the right-left direction, and it is the best that the points P3 and P4 are located in the same places as the elastic members 24 and 26 are located, respectively, with respect to the right-left direction.

Further, the entirety of the pull force may be transmitted from the handle 20 to the tray body 19 via the elastic members 24 and 26. In other words, the contact part 204 does not need to have contact portions P1 and P2.

As has been described above, in each of the trays and the image forming apparatus according to the embodiments of the present invention, collision noise occurring with a draw of a tray can be reduced.

Although the present invention has been described in connection with the preferred embodiments above, it is to be noted that various changes and modifications are possible for persons in the field. Such changes and modifications are to be understood as being within the scope of the present invention.

What is claimed is:

1. A tray that is constructed to be drawable from an image forming apparatus body in a specified first direction, the tray comprising:

a tray body in which a plurality of printing media are stored;

a handle that is fastened to the tray body so as to be slidable the specified first direction by a specified distance, a pull of the handle in the specified first direction effecting a slide of the handle in the first direction relative to the tray body and applying a pull force in the specified first direction to the tray body;

a lock mechanism for locking the tray body in the image forming apparatus body, the slide of the handle in the specified first direction relative to the tray body cancelling the lock mechanism; and an elastic member located between the handle and the tray body;

wherein the elastic member contacts both the handle and the tray body when the handle is slid in the specified first direction, and at least part of the pull force is transmitted from the handle to the tray body via the elastic member.

2. The tray according to claim 1, wherein at least part of the pull force is transmitted from the handle to the tray body via the elastic member after the lock mechanism is cancelled.

3. The tray according to claim 1, wherein the handle has a contact part to come into contact with the tray body when the handle slides in the specified first direction by the specified distance relative to the tray.

4. The tray according to claim 3, wherein the handle has two contact portions to come into contact with the tray body; and wherein the elastic member is located between the two contact portions.

5. The tray according to claim 3, wherein two elastic members are provided between the handle and the tray body; and wherein contact portions are located between the two elastic members.

6. The tray according to claim 1, wherein the tray body comprises:

a storage section in which a plurality of printing media are stored;

a front cover fixed to a side of the storage section that is an end of the storage section in the specified first direction;

wherein the handle is fastened to the front cover; and wherein a connection where the front cover and the storage section are connected together is in a same place as the elastic member with respect to a lengthwise direction of the front cover.

7. The tray according to claim 1, wherein the elastic member is fixed to the handle.

8. A tray that is constructed to be drawable from an image forming apparatus body in a specified first direction, the tray comprising:

a tray body in which a plurality of printing media are stored;

a handle that is fastened to the tray body so as to be slidable the specified first direction by a specified distance, a pull of the handle in the specified first direction effecting a slide of the handle in the first direction relative to the tray body and applying a pull force in the specified first direction to the tray body;

a lock mechanism for locking the tray body in the image forming apparatus body, the slide of the handle in the specified first direction relative to the tray body cancelling the lock mechanism; and an elastic member located between the handle and the tray body;

wherein at least part of the pull force is transmitted from the handle to the tray body via the elastic member;

wherein the handle has a contact part to come into contact with the tray body when the handle slides in the specified first direction by the specified distance relative to the tray; and wherein the elastic member comes into contact with both the handle and the tray body before the contact part of the handle comes into contact with the tray body.

9. An image forming apparatus comprising:

an image forming apparatus body; and a tray that is constructed to be drawable from the image forming apparatus body in a specified first direction, the tray comprising:

a tray body in which a plurality of printing media are stored;

a handle that is fastened to the tray body so as to be slidable in the specified first direction by a specified distance, a pull of the handle in the specified first direction effecting a slide of the handle in the first direction relative to the tray body and applying a pull force in the specified first direction to the tray body;

a lock mechanism for locking the tray body in the image forming apparatus body, the slide of the handle in the specified first direction relative to the tray body cancelling the lock mechanism; and an elastic member located between the handle and the tray body;

wherein the elastic member contacts both the handle and the tray body when the handle is slid in the specified first direction, and at least part of the pull force is transmitted from the handle to the tray body via the elastic member.

10. The image forming apparatus according to claim 9, wherein at least part of the pull force is transmitted from the handle to the tray body via the elastic member after the lock mechanism is cancelled.

11. The image forming apparatus according to claim 9, wherein the handle has a contact portion to come into contact with the tray body when the handle slides in the specified first direction by the specified distance relative to the tray.

12. The image forming apparatus according to claim 11, wherein the handle has two contact portions to come into contact with the tray body; and wherein the elastic member is located between the two contact portions.

13. The image forming apparatus according to claim 11, wherein two elastic members are provided between the handle and the tray body; and wherein the contact portion is located between the two elastic members.

14. The image forming apparatus according to claim 9, wherein the tray body comprises:

a storage section in which a plurality of printing media are stored;

a front cover fixed to a side of the storage section that is an end of the storage section in the specified first direction;

wherein the handle is fastened to the front cover; and wherein a connection where the front cover and the storage section are connected together is in a same place as the elastic member with respect to a lengthwise direction of the front cover.

15. The image forming apparatus according to claim 9, wherein the elastic member is fixed to the handle.

16. An image forming apparatus comprising:

an image forming apparatus body; and a tray that is constructed to be drawable from the image forming apparatus body in a specified first direction, the tray comprising:

a tray body in which a plurality of printing media are stored;

a handle that is fastened to the tray body so as to be slidable in the specified first direction by a specified distance, a pull of the handle in the specified first direction effecting a slide of the handle in the first direction relative to the tray body and applying a pull force in the specified first direction to the tray body;

a lock mechanism for locking the tray body in the image forming apparatus body, the slide of the handle in the specified first direction relative to the tray body cancelling the lock mechanism; and an elastic member located between the handle and the tray body;

wherein at least part of the pull force is transmitted from the handle to the tray body via the elastic member;

wherein the handle has a contact portion to come into contact with the tray body when the handle slides in the specified first direction by the specified distance relative to the tray; and wherein the elastic member comes into contact with both the handle and the tray body before the contact portion of the handle comes into contact with the tray body.

* * * * *